US010076695B1

(12) United States Patent
Simon

(10) Patent No.: US 10,076,695 B1
(45) Date of Patent: Sep. 18, 2018

(54) HOCKEY REBOUNDER, SLIDE BOARD

(71) Applicant: Thomas Chapman Simon, Manchester, NH (US)

(72) Inventor: Thomas Chapman Simon, Manchester, NH (US)

( * ) Notice: Subject to any disclaimer, the term of this patent is extended or adjusted under 35 U.S.C. 154(b) by 0 days.

(21) Appl. No.: 15/612,286

(22) Filed: Jun. 2, 2017

(51) Int. Cl.
*A63B 69/00* (2006.01)

(52) U.S. Cl.
CPC ..... *A63B 69/0026* (2013.01); *A63B 69/0024* (2013.01)

(58) Field of Classification Search
CPC . A63B 69/0026; A63B 69/0024; A63B 69/00; A63B 2069/0004
See application file for complete search history.

(56) References Cited

U.S. PATENT DOCUMENTS 3,065,971 A * 11/1962 Coles ..... A63B 57/405 473/182
3,342,495 A * 9/1967 Wasley ..... A63B 69/3661 473/164
4,340,214 A * 7/1982 Schutzer ..... A63B 22/203 482/51
4,460,176 A * 7/1984 Peters ..... A63F 7/3075 473/182
4,779,862 A * 10/1988 Keppler ..... A63B 69/0022 482/51
4,940,226 A * 7/1990 Carra ..... A63B 69/0022 434/253
5,076,571 A * 12/1991 Croce, Jr. ..... A63B 69/0022 482/51
5,114,387 A * 5/1992 Keppler ..... A63B 21/4037 482/51
5,133,700 A * 7/1992 Braathen ..... A63B 69/0022 472/118
D330,922 S * 11/1992 Novakoski ..... D21/686
D349,139 S * 7/1994 Markland ..... D21/686
5,326,338 A * 7/1994 Makous ..... A63B 69/0022 482/51
5,351,960 A * 10/1994 Knapp ..... A63B 57/405 473/182
5,362,045 A * 11/1994 Hammett ..... A63B 69/0026 473/435
5,393,282 A * 2/1995 Maclean ..... A63B 69/0022 482/51
6,364,790 B1 4/2002 Carrie
D628,253 S * 11/2010 McKinney ..... D21/722
D637,669 S * 5/2011 McKinney ..... D21/722
(Continued)

*Primary Examiner* — Mitra Aryanpour
(74) *Attorney, Agent, or Firm* — Lambert & Associates; Gary E. Lambert; David J. Connaughton, Jr.

(57) ABSTRACT

A hockey training device is provided. The training device includes a substantially flat sheet with a smooth upper surface. The present invention includes a plurality of elastic band suspended to the upper surface. A first vertical post and a second vertical post may be attached to the flat sheet so that the elastic band is secured about the first and second vertical posts. The elastic band includes a front surface facing towards a center portion of the flat sheet. Therefore, a puck may be passed towards the elastic band and the elastic band rebounds the puck towards the user. The device may be used to train both backhand and forehand shooting and pucks skills. Further, the device may be used to train a sliding skating motion in a skating training mode.

18 Claims, 7 Drawing Sheets

(56) References Cited

U.S. PATENT DOCUMENTS

| | | | | |
|---|---|---|---|---|
| 8,469,841 | B1 * | 6/2013 | Giauque | A63B 69/0026 473/446 |
| 9,636,561 | B2 * | 5/2017 | Simon | A63B 69/0026 473/446 |
| D798,400 | S * | 9/2017 | Klanow | D21/698 |
| D801,456 | S * | 10/2017 | Simon | D21/698 |
| 2005/0032580 | A1 * | 2/2005 | Rango | A63B 69/3676 473/164 |
| 2009/0042659 | A1 | 2/2009 | Breaker | |
| 2009/0215548 | A1 | 8/2009 | Broering | |
| 2014/0256476 | A1 * | 9/2014 | Sallinen | A63B 69/0026 473/446 |
| 2015/0297967 | A1 * | 10/2015 | Simon | A63B 69/0026 473/446 |

* cited by examiner

HOCKEY REBOUNDER, SLIDE BOARD

BACKGROUND OF THE INVENTION

The present invention relates to ice hockey and, more particularly, to an ice hockey trainer.

Ice hockey is a contact team sport played on ice, usually in a rink, in which two teams of skaters use their sticks to shoot a puck into their opponent's net to score goals. Hockey training typically occurs in an ice rink. Ice time is expensive and is not always accessible. Stick handling, shooting, passing the puck, and skating are essential skills to improve performance while playing ice hockey.

As can be seen, there is a need for an off the ice training device to improve puck handling skills and skating skills of a hockey player.

SUMMARY OF THE INVENTION

In one aspect of the present invention, a hockey training device comprises: a first flat sheet comprising a smooth upper surface; and a plurality of elastic bands suspended to the upper surface and each comprising a front surface substantially perpendicular to the flat sheet, wherein the front surface of each of the plurality of elastic bands is facing towards a center portion of the flat sheet.

In another aspect of the present invention, a hockey training device comprises: a first flat sheet and a second flat sheet each comprising a smooth upper surface, wherein the first flat sheet and the second flat sheet are connected together by a hinge; and at least one elastic band suspended to the upper surface of the first flat sheet and comprising a front surface substantially perpendicular to the first flat sheet, wherein the front surface of the at least one elastic band is facing towards a center portion of the hockey training device.

These and other features, aspects and advantages of the present invention will become better understood with reference to the following drawings, description and claims.

DETAILED DESCRIPTION OF THE INVENTION

Figure 1:
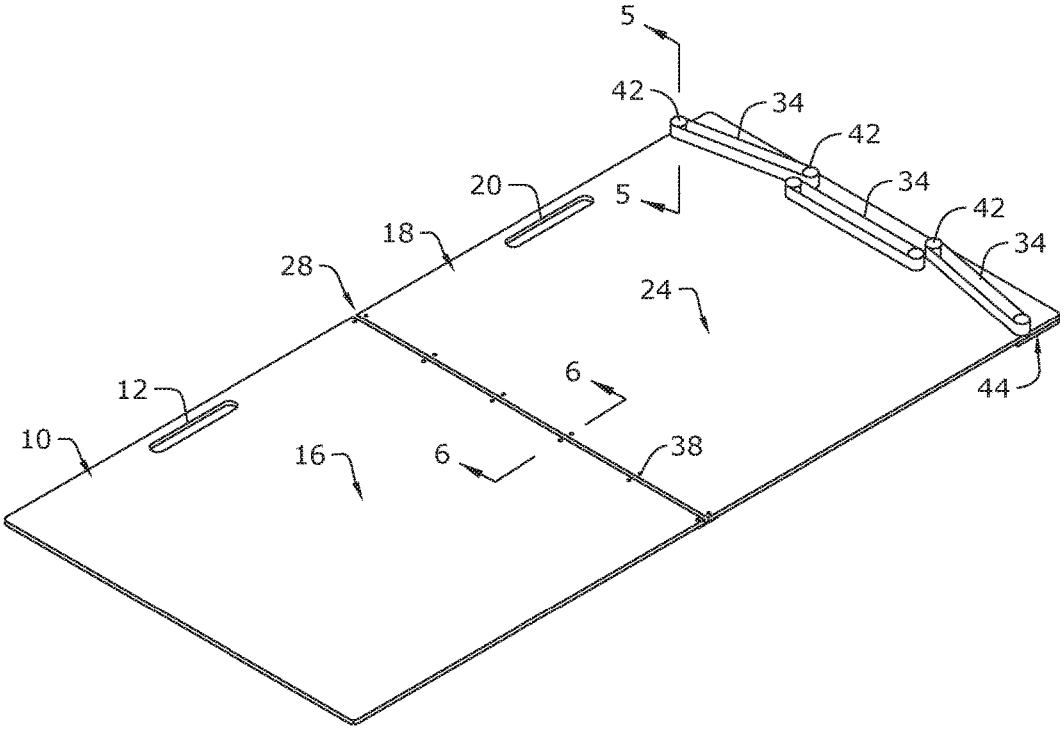
FIG. 1 is a top perspective view of an embodiment of the present invention.
Figure 2:
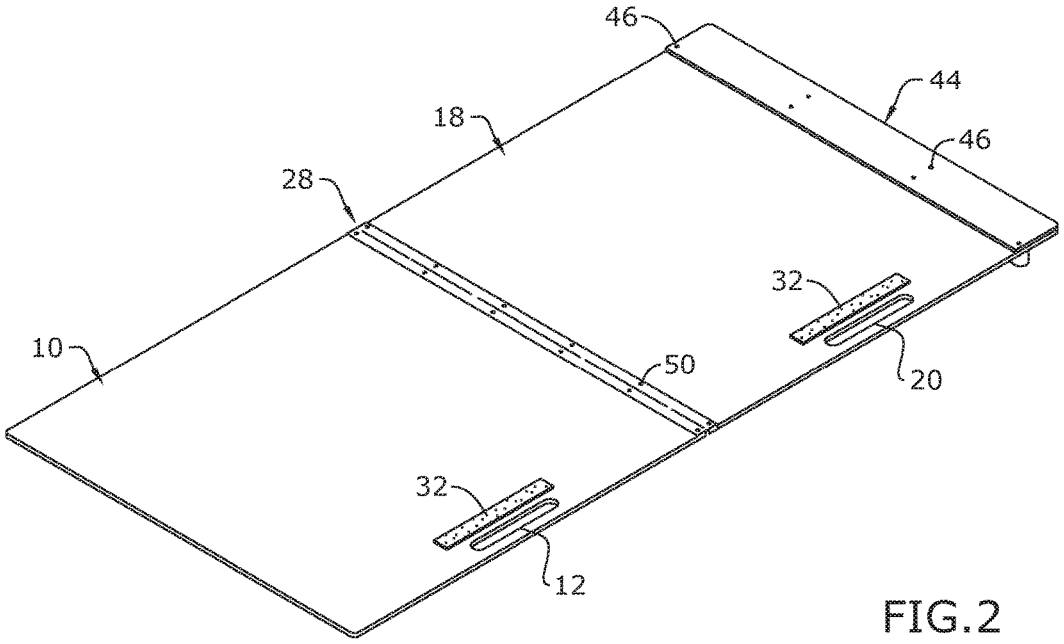
FIG. 2 is a bottom perspective view of an embodiment of the present invention.
Figure 3:
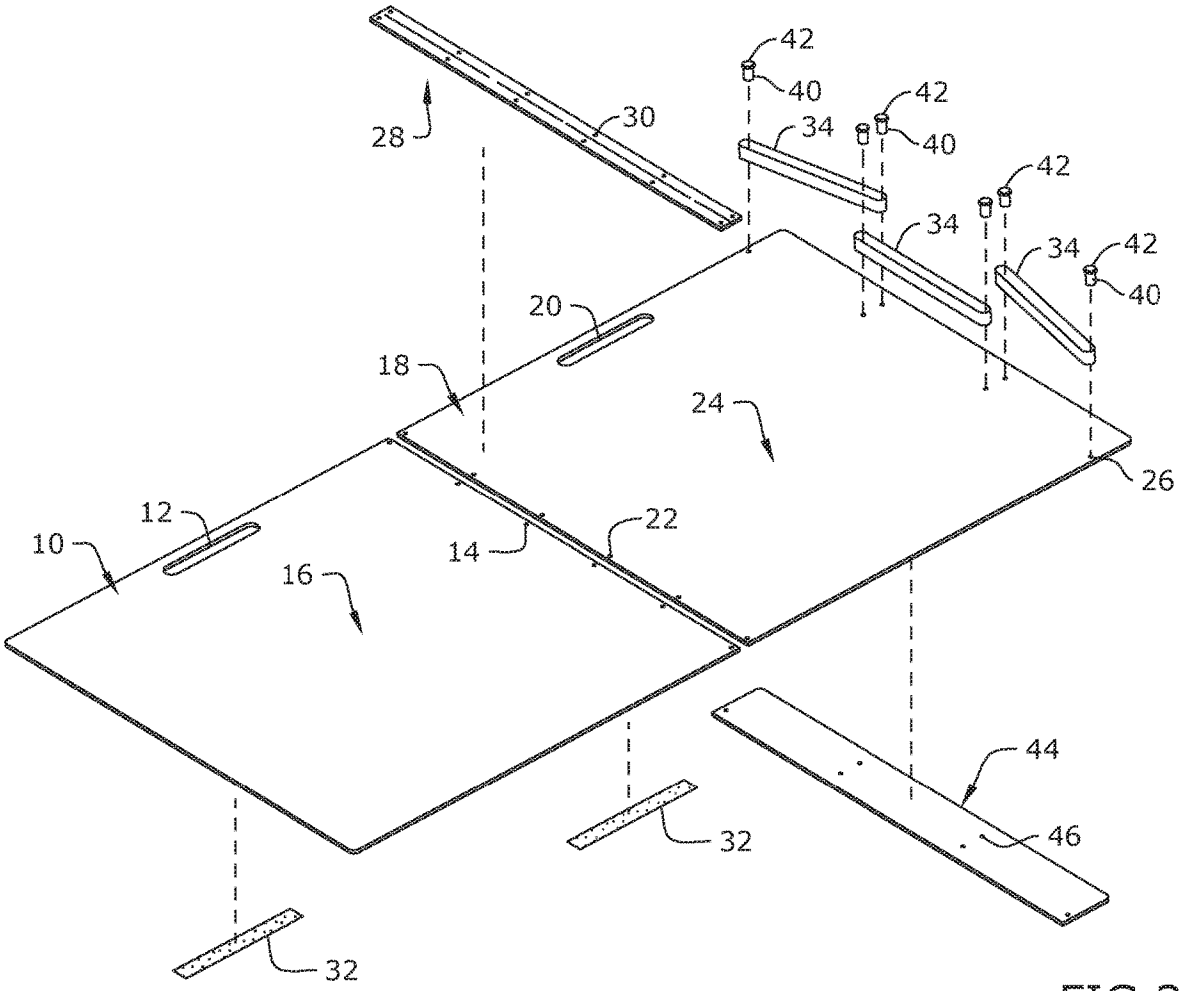
FIG. 3 is an exploded view of an embodiment of the present invention.
Figure 4:
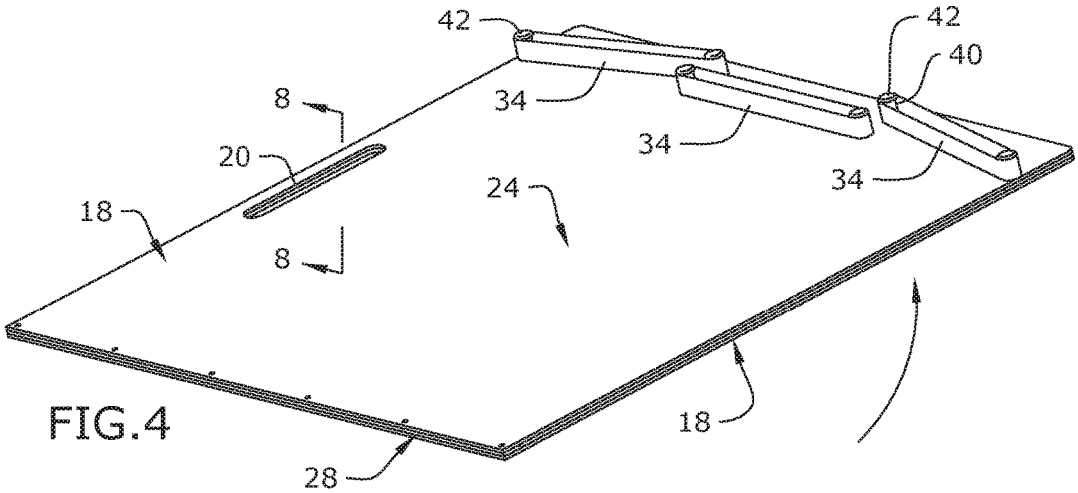
FIG. 4 is a perspective view of an embodiment of the present invention in a folded state.
Figure 5:
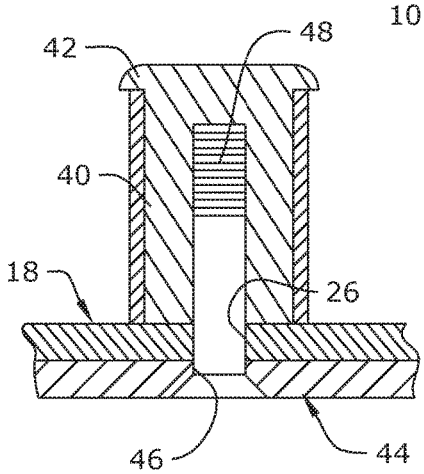
FIG. 5 is a section detail view of the present invention along line 5-5 in FIG. 1.
Figure 6:
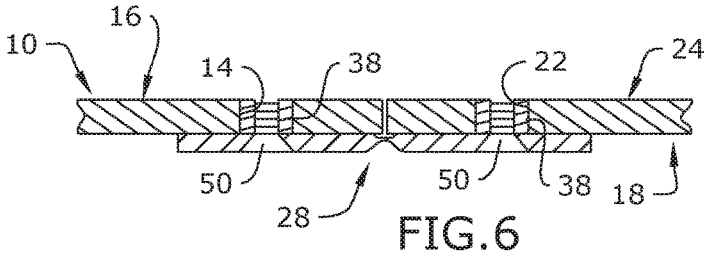
FIG. 6 is a section detail view of the present invention along line 6-6 in FIG. 1.
Figure 7:
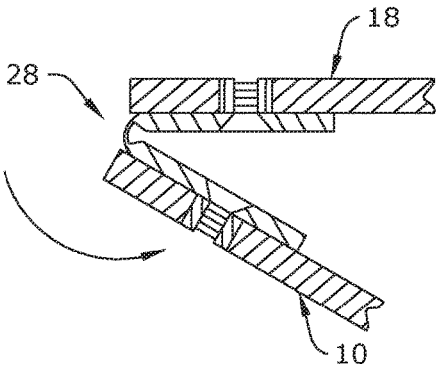
FIG. 7 is a section detail view of the present invention demonstrating a live hinge in operation.
Figure 8:
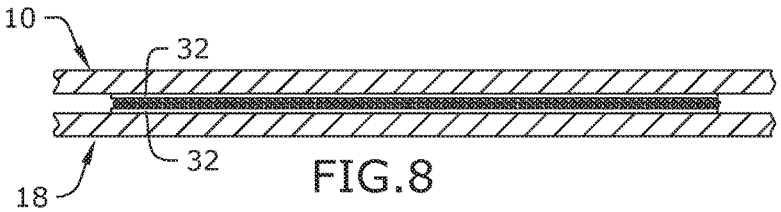
FIG. 8 is a section detail view along line 8-8 in FIG. 4.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an ice hockey training aid used to promote and develop essential hockey puck skills such as shooting, passing, and stick handling, as well as training skating methods. The present invention eliminates the need for costly ice time to practice individual puck skills. The present invention can be used all year round inside or outside increasing the player's practice time to develop essential skills.

The present invention includes a uniquely designed system integrated with three angled rebounding bands that enhances real hockey situations. Engineered utilizing advanced fabricated plastic polymers improves smooth puck sliding performance with a secure and tight mechanism increasing rebounding performance.

Referring to FIGS. 1 through 12, the present invention includes a hockey training device. The training device includes a substantially flat first sheet 18 with a smooth upper surface 24. The present invention includes at least one elastic band 34 suspended to the upper surface. A first vertical post 40 and a second vertical post 40 may be attached to the first flat sheet 18 so that the elastic band 34 is secured about the first and second vertical posts 40. The elastic band 34 includes a front surface facing towards a center portion of the first flat sheet 18. Therefore, a puck may be passed towards the elastic band 34 and the elastic band 34 rebounds the puck towards the user.

In certain embodiments, the present invention may include a plurality of bands 34 oriented at different angles in order to rebound the puck back to the center portion of the first flat sheet 18. For example, the present invention may include a first elastic band 34 suspended in between a second elastic band 34 and a third elastic band 34. A front surface of the second elastic band 34 and the third elastic band 34 are suspended at an angle relative to the front surface of the first elastic band 34 so that the front surfaces of each of the elastic bands 34 are facing towards the center portion of the flat sheet 18. Therefore, the user may shoot to the middle, to the left or to the right, and the puck may rebound to the same center portion of the flat sheet 18.

The vertical posts 40 of the present invention may be mounted to the flat sheet 18 via apertures 26, 46 and fasteners 48. In certain embodiments, the present invention may include a backer plate 44 including a plurality of apertures 46. The flat sheet 18 includes apertures 26 that align with the apertures 46 of the backer plate 44. The fasteners 48 may run through the aligned apertures 26, 46 and into the vertical posts 40, thereby connecting the backer plate 44 to a lower surface of the first flat sheet 18 and the vertical posts 40 to the upper surface of the first flat sheet 18. In certain embodiments, the vertical posts 40 may include post flanges 42 extending radially from the post 40 to prevent the bands 34 from slipping off the posts 40.

In certain embodiments, the present invention may include a second flat sheet 10 with a smooth upper surface 16 substantially the same as the first flat sheet 18. The second flat sheet 10 may be connected to the first flat sheet 18 by a hinge 28, and may thereby fold relative to one another into a folded position. In certain embodiments, the first flat sheet 18 and the second flat sheet 10 may each include cutout portions along an edge, forming handles 12 and 20. A connector may releasably connect the first flat sheet 18 and the second flat sheet 10 in a folded position. The connector may include a hook and loop fastener 32 attached to the lower surfaces of the first flat sheet 18 and the second flat sheet 10.

Therefore, the first flat sheet 18 and the second flat sheet 10 may be folded about the hinge 28 and the lower surfaces may be attached to one another. The handles 12 and 20 may align, and a user may easily transport the folded hockey training device.

The hinge 28 of the present invention may connect adjacent edges of the first flat sheet 18 and the second flat sheet 10. The hinge 28 may be a polymer hinge 28. In certain embodiments, the hinge 28 may include a first thick panel attached to the first flat sheet 18, a second thick panel attached to the second flat sheet 10, and a thin portion connecting the first thick panel and the second thick panel. The first flat sheet 18 may include apertures 22 that align with apertures 30 on the first thick panel, and the second sheet 10 may include apertures 14 that align with apertures 30 on the second thick panel. Brass threaded inserts 38 may be within apertures 14 and 22. Fasteners 50 may run through the aligning apertures 30 and inserts 38, thereby connecting the hinge 28 to the first flat sheet 18 and the second flat sheet 10. The hinge 28 may fold about the thin portion, thereby folding the first flat sheet 18 and the second flat sheet 10 together.

In certain embodiments, the first flat sheet 18 and the second flat sheet

10 of the present invention may be made of natural white high density polyethelene plastic sheeting. The plastic sheeting provides a smooth upper surface so that the puck may easily glide similar to gliding on ice. The dimensions of the plastic sheeting may also vary. For example, the plastic sheeting may be, but is not limited to, about 40"×60", 40"×80", 40"×96", about 30"×96", or other suitable dimensions. The thicknesses may include, but are not limited to, 0.093", 0.187", 0.125" or the like. The elastic bands 34 may be rubber bands, such as ethylene propylene diene monomer (EPDM) that may be about 1.125 includes wide, about 0.063 inches thick, and having about sixteen inch flat front surface. The elastic bands 34 may be UV resistant. The vertical posts may be made of acetyl plastic.

Figure 9:
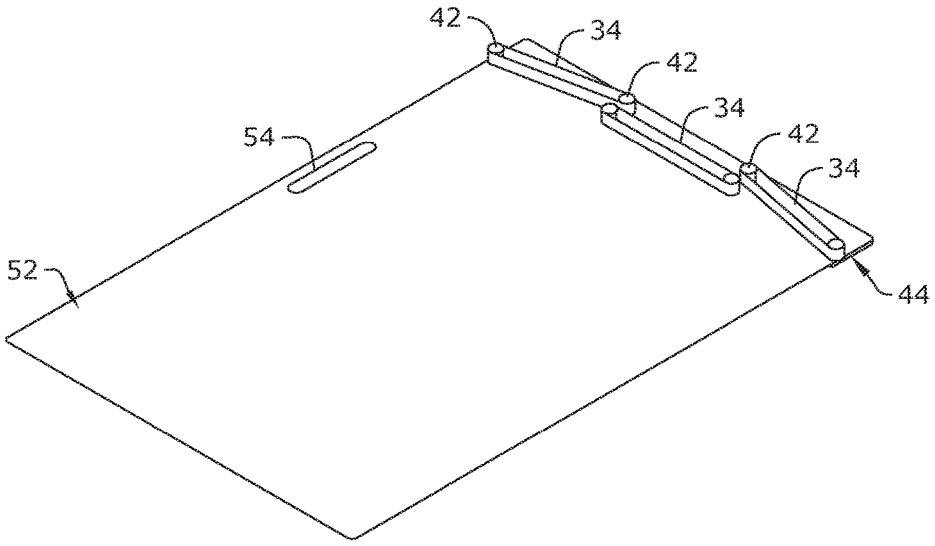
FIG. 9 is a perspective view of an embodiment of the present invention.
Figure 10:
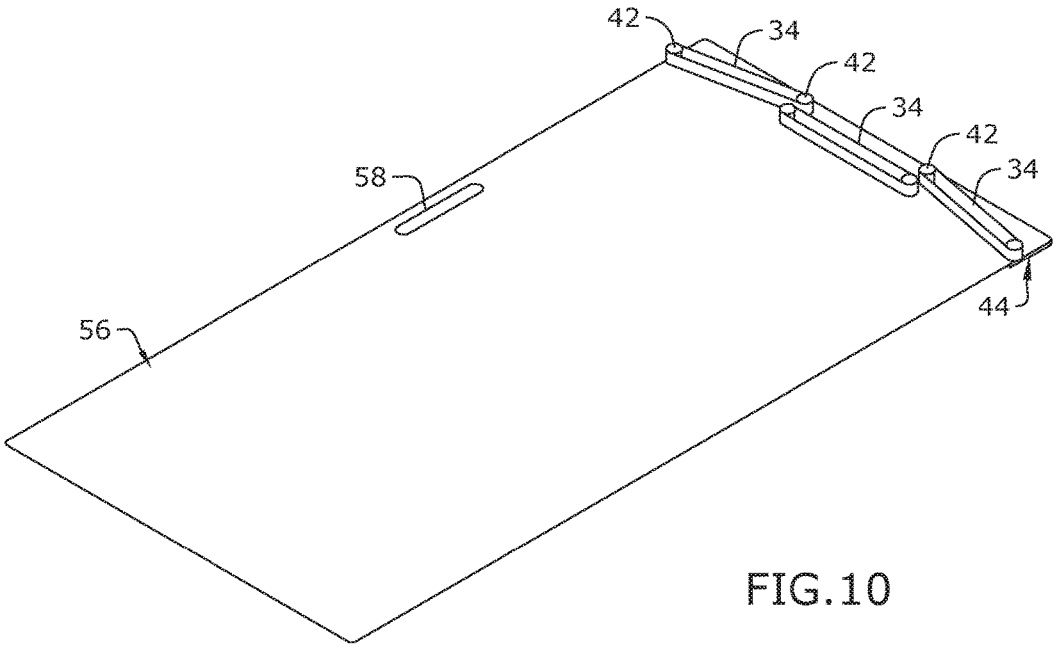
FIG. 10 is a perspective view of an embodiment of the present invention.
Figure 11:
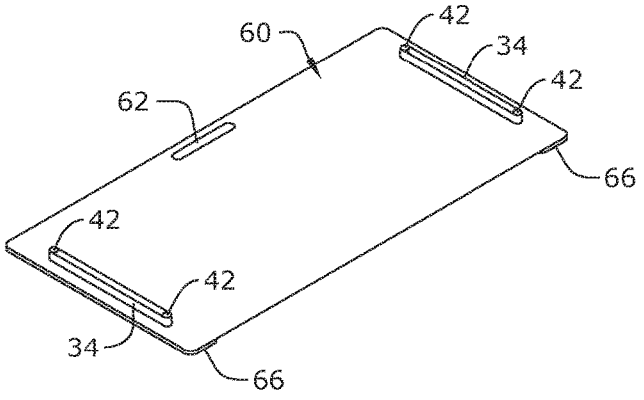
FIG. 11 is a perspective view of an embodiment of the present invention.
Figure 12:
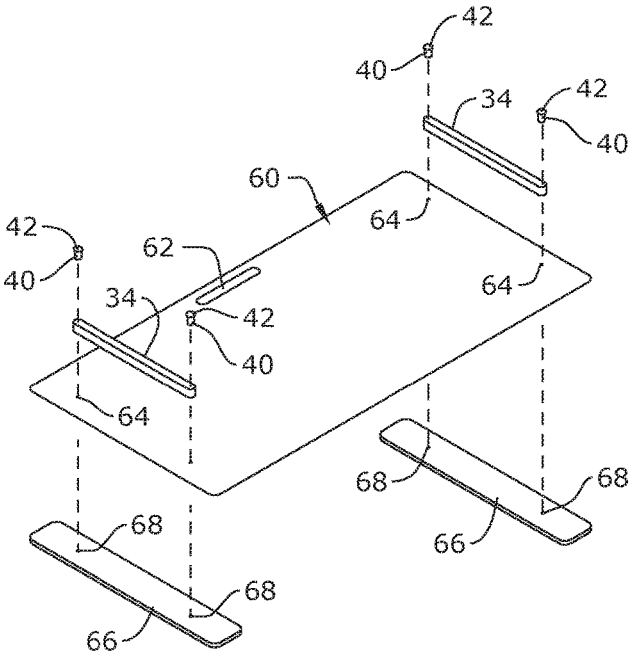
FIG. 12 is a perspective view of an embodiment of the present invention.

As illustrated in the Figures, the present invention may come in multiple shapes and sizes. As illustrated in FIG. 9, the flat sheet 52 may include a shorter length, and may not be hingedly connected to another sheet. The flat sheet 52 may include a cutout portion 54 for the handle. FIG. 10 may include a flat sheet 56 with a longer length, which is also not hingedly connected to another sheet. The flat sheet 56 may include a cutout portion 58 for the handle. The seamless flat sheets 52, 56 may include, but are not limited to, the following dimensions, about 40"×60" and about 40"×80", about 30"×96", or other suitable dimensions. As illustrated in FIGS. 11 and 12, the present invention may include a band 34 suspended on opposing sides of the sheet 60. Each side may include a backer plate 66 that has apertures 68 that align with apertures 64 formed through the sheet 60. Thereby, the backers 66 may be suspended to the sheet 60 through the aligning apertures 64, 68 via fasteners. In certain embodiments, the sheet 60 may include, but is not limited to, the following dimensions, about 40"×60", 40"×80", 40"×96", about 30"×96", or other suitable dimensions. It should be understood that the board may have bands at one or both ends.

Figure 13:
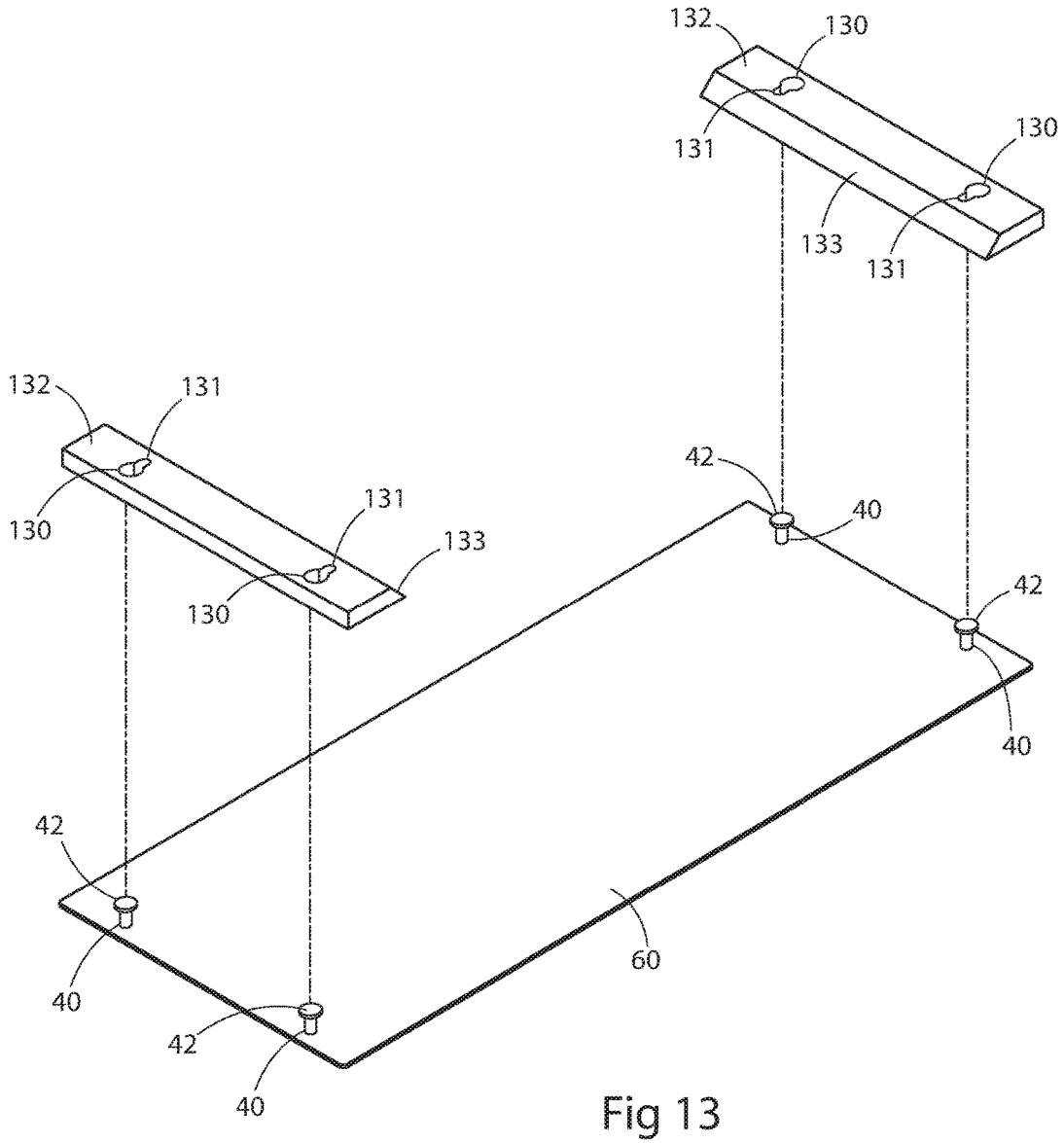
FIG. 13 is a perspective view of another embodiment of the present convertible between a rebounding device and a slide board.
Figure 14:
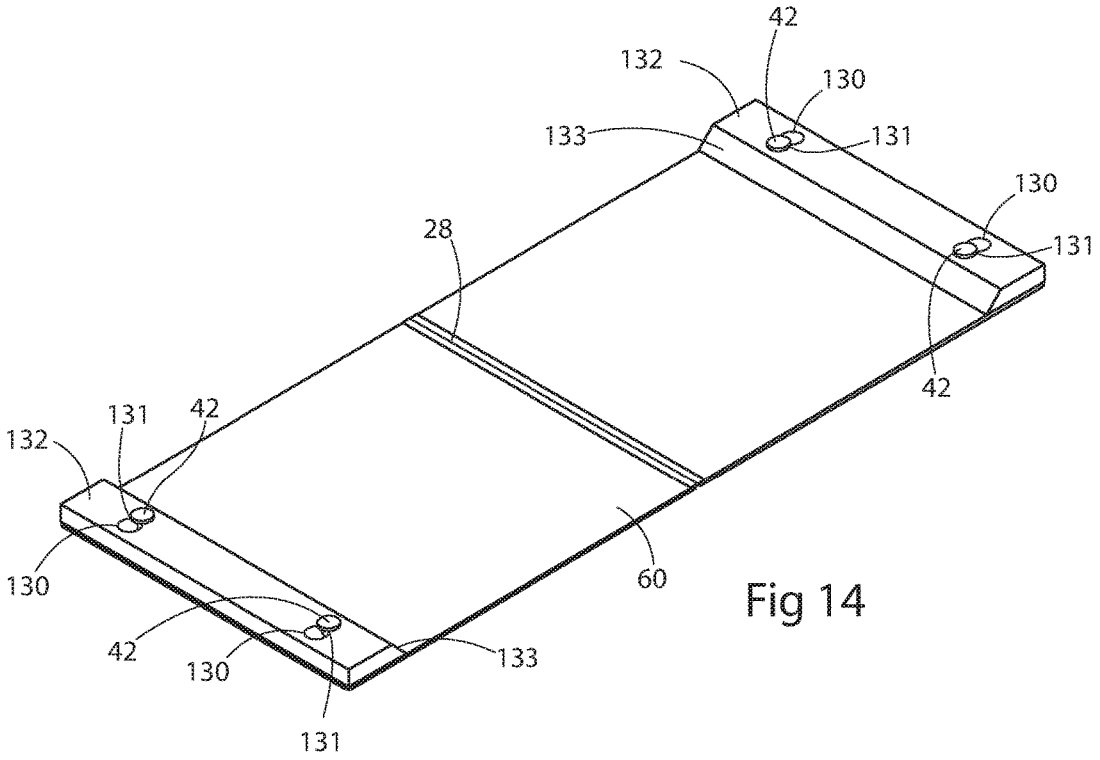
FIG. 14 is a perspective view of yet another embodiment of the present convertible between a rebounding device and a slide board.

Turning now to FIGS. 13 and 14, a view of another embodiment of the present invention that is convertible between a hockey rebounding device to a hockey slide training device is shown. In this view, a sheet 60, similar to sheets in other embodiments, has vertical posts 40 extending at each lengthwise end. Elastic bands 34 can be attached to these posts 40, and flange 42 limits their sliding off unintentionally. The elastic bands 34 may be removed by stretching them away and over the posts 40. Once removed, slide blocks 132 may be attached to the posts 40. Once attached, as seen in FIG. 14, the device may allow a user to practice a sliding skating motion side to side, sliding one foot until it contacts block 132, and then may push against this block to slide across the board 60 to the other block 132, and repeating until the training is completed. This sliding training mimics the motion used by a skater when ice (or inline, etc.) skating. As such, the device can be converted between a skating training device in the slide board mode (having the slide blocks 132 attached, and a puck skill training device (when the elastic bands are attached) when in the hockey puck training mode. In one embodiment, the sheet 60 may be folded about a hinge. In another embodiments, the sheet may be rollable. A rubber mat may be positioned on a bottom of the sheet 60 to limit sliding.

Figure 15:
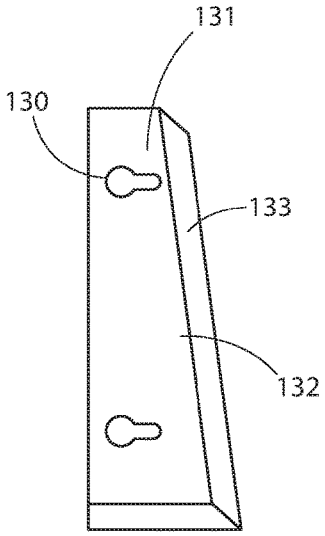
FIG. 15 is an elevation view of an embodiment of a block of the present invention.
Figure 16:
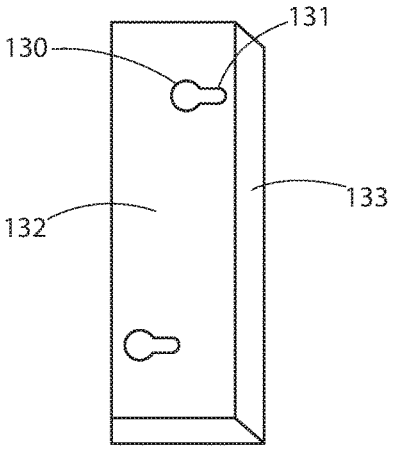
FIG. 16 is an elevation view of another embodiment of a block of the present invention.

Slide block 132 is attachable to the posts 40 by a key slot configuration having a wide circular region 130 which is large enough for flanges 42 to fit through. The key slot further has a narrow region 131 which is wide enough to fit posts 40, but not wide enough for flanges 42 to pass through. When connecting, a user passes the flanges and posts through wide circular region 130 and then slides the block towards a lengthwise end of the sheet 60 causing the posts 40 to be over the narrow region 131, which prevents upward movement of the block 132 because the flanges 42 are locked over the top surface of the block 132. In FIGS. 13 and 14, the slots 130, 131 are shown aligned in a lengthwise direction of the block 132. Other embodiments may include those included in FIGS. 15 and 16. For example, FIG. 15, the block 132 has key slots aligned in a lengthwise direction on the block 132, and an angled face 133 such that the block has a more narrow width at a first end than a second end. This width tapers outward to a wider width at a second end. As such, the block 132 provides an angled foot receiving area so that a toe is pointed outwardly from the user's body. Similarly, in FIG. 16, the key slots 130, 131 are offset from each other so that a first key slot is positioned closer to a right side edge of the block 132, while a second key slot is positioned closer to a left side edge of the block 132. When attached to the posts 40, the bock will be angled on the sheet, providing an angled foot receiving area so that a toe is pointed outwardly from the user's body.

In some embodiments, such as the embodiment shown in FIGS. 13 and 14, the slide block 132 may have an angled portion 133, which slopes downward in a wedge shape. This may provide a better surface for the side of the user's foot. In other embodiments, however, the slide block 132 may have a flat leading edge.

As stated above, Ice Hockey players have little individual time to develop essential hockey puck skills such as stick handling, passing, skating and shooting techniques. Regular practices focus on team play rather than individual skill enhancement. The present invention claimed here solves this problem.

This training aid eliminates the need for costly ice time to practice individual puck skills and train on skating methods. This aid can be used year round inside or outside increasing the player's practice time to develop essential skills.

The claimed invention differs from what currently exists. Prior to this device, there are no other ice hockey plastic puck skills training aid that fold conveniently in half. This feature makes portability easy, saves on storage space, and reduces shipping costs.

This aid comes fully assembled and ready to use. Other devices require various assembly options and sourcing of required parts causing inconsistencies and poor performance. Needed adjustments are required to maintain performance.

The uniquely designed system, integrated with three separate angled rebounding bands incorporated in the (Puck Sliding Surface) enhances real hockey situations. Advanced plastic polymers improve smooth puck sliding performance with secure tight mechanism increasing rebounding power.

The Version of the Invention Discussed Here Includes:

1. Puck Sliding Surface A—Natural High Density Polyethylene Plastic sheet 3⁄16" thick×40"×40". 6 Drilled holes 3⁄16" in diameter in a particular pattern to match up with the same pattern as a Backer Plate for attaching rebounding system. 6 drilled holes 0.261" diameter used to attach poly hinge. Router hole for handle 1"×4½" matches up exactly to routed hole on Puck Sliding Surface B when board is folded making a handle.
2. Puck Sliding Surface B— Natural High Density Polyethylene plastic sheet 3⁄16" thick×40"×40"×3⁄16" thick. 6 drilled holes diameter 0.0261". Drilled holes are for attaching poly hinge.
3. Backer Plate—Lexan polycarbonate plastic ¼" thick× 4¾"×40". 6 drilled and counter sunk holes for attaching rebounder system. All 4 corners 1" radius. 4.
4. Post—6 Natural acetyl plastic commonly called Delrin. 1"×1⅛" length. Drilled and tapped on bottom side 10/32" thread.
5. Band—EPDM Ethylene Propylene Diene Monomer, 8" flat length×1¼" wide×0.063" wall.
6. Insert—Brass Press-Fit Insert. 10-32 inch internal Thread, 3⁄16".
7. Backer Screw—Machine Flat Head Screw 10-32" thread×1" length.
8. Poly Hinge—Black Polypropylene UV resistant 1½" wide×40" long×1⁄10" thick.
9. Fasteners Strips—Velcro strips ¾"×3".
10. Hinge Screw—Machine Flat Head 10/32" thread×¼" length.

Relationship Between the Components:

The puck sliding surface A and B connect together to make up the total surface of the Puck Sliding Surface which folds and unfolds. They are connected on the back side utilizing the Insert, and the hinge screw, and the Poly Hinge. The backer Plate attaches to back side of puck sliding surface A using backer screws and posts. The band stretches around 2 posts in 3 separate locations creating 3 separate angled rebounding bands. The Fastener Strips place in same mirror image on back of puck sliding surface A and B meeting together holding the board folded in place until ready for use.

How the Invention Works:

With the use of a High Density Polyethylene Plastic sheet which has a low coefficient of friction and an EPDM elastic band. The puck is passed into the rebounding bands which makes the puck slide freely back to the player. This action simulates real hockey situations without using real ice. The Puck Sliding surface protects expensive hockey stick from rough surfaces such as a driveway. Further, when in a skating motion training mode, a user may use the slide blocks to push off and slide across the sheet until the opposite foot reaches the opposite slide block, and again push off, repeating this motion during the training.

How to Make the Invention:

1. Using 3⁄16" thick Natural HDPE (High Density Polyethylene) each Plastic sheet puck sliding surface A and B is cut to size 40"×40".
2. 6 drilled thru holes with diameter of 0.261" in each puck sliding surface A and
   B. The pattern and position of the holes are in the same place on both parts. Brass Inserts are press fitted in the 12 holes 6 on each side.
3. Poly Hinge is cut to length 40". 12 drilled countered sunk holes 6 on each side of hinge. Using the Hinge Screw to connect Poly Hinge to back side of puck sliding surface A and B connecting both parts together.
4. Puck sliding surface A Has additional 6 drilled thru holes diameter 0.261" used to attached the Backer Plate which has the same hole pattern.
5. The Backer Plate, Lexan (Polycarbonate) Plastic sheet ¼" thick cut to size
   40"×4.75". 6 counter sunk drilled thru holes 0.196" diameter. Hole pattern the same as puck sliding surface A. All 4 corners have 1" radius.
6. Acetal Plastic natural 1" diameter rod. (Commonly called Delrin) isCNC machined into post drilled and tapped with 10/32" screwthread.
7. Using the Screws that are used to assemble the backer plate to puck sliding surface A and the Post in a secure tight fashion.
8. Velcro® Strips are applied, pressure sensitive in the same position on both puck sliding surface A and B below the handle hole.

The HDPE natural 3⁄16" Plastic sheet, Elastic EPDM band and poly hinge are included in the present invention. The routed hole for carrying handle is optional. By adding elastic EPDM bands to both ends of the Training Aid the player could pass in both directions using forehand and back handed stick handling motions. Not able to interchange or reconfigure to achieve same results.

How to Use the Invention:

A hockey player unfolds the training aid and stands next to the device with a hockey stick and puck. The player passes the puck into one of three angled rebounding bands which rebounds the puck freely back to the player keeping the puck in motion, like a puck on ice. The player then practices stick handling moves like a "Toe Drag" and then shoots the puck into a street hockey goal net using different types of shots, such as a slap shot, snap shot, or wrist shot.

The present invention includes an ice hockey training aid used to develop hockey puck skills, such as shooting, passing and stick handling is disclosed. The present invention is uniquely designed device that folds in half. A rebounding system is integrated into the puck sliding surface with three separate angled rebounding bands, which enhances real hockey situations. The present invention is engineered utilizing advanced plastic polymer parts, which improves smooth puck sliding performance with a secure and tight mechanism increasing rebounding power.

It should be understood, of course, that the foregoing relates to exemplary embodiments of the invention and that modifications may be made without departing from the spirit and scope of the invention as set forth in the following claims.

What is claimed is:

1. A hockey training device for training a puck handling in a first mode and for training a skating motion in a second mode comprising:

a substantially flat sheet;

a first pair of posts extending from the substantially flat sheet at a first end, each of the first pair of posts having a flange extending radially outwardly at a top of the post;

a second pair of posts extending from the substantially flat sheet at a second end, each of the second pair of posts having a flange extending radially outwardly at a top of the post;

a first elastic band connectable about the first pair of posts, and a second elastic band secured about the second pair of posts when the hockey training device is in the first mode;

a first slide block connectable to the first pair of posts, and a second slide block connectable to the second pair of posts when the hockey training device is in a slide board the second mode; and each of the slide blocks comprising a block base, and two key hole slots defined in the base, each key hole slot having a circular region sized to allow passage of the flange of each post, and having a narrow region sized to allow passage of the post, but to prevent passage of the flange of each post.

2. The hockey training device of claim 1 wherein the key slots of each slide block are aligned in a lengthwise direction of the block.

3. The hockey training device of claim 1 wherein the key slots of each slide block are linearly offset in a lengthwise direction of the block.

4. The hockey training device of claim 1 wherein the flat sheet further comprises a hinge, the hinge connecting a first and second portion of the flat sheet, wherein the hinge is formed having a first thick panel attached to a bottom surface of the first sheet portion, a second thick panel attached to a bottom surface of the second sheet portion, and a thin portion connecting the first thick panel and second thick panel, the thin portion having a thickness less than a thickness of the first thick panel and a thickness of the second thick panel, wherein the first thick panel and second thick panel are movable about the thin portion.

5. The hockey training device of claim 4 wherein the first sheet portion further defines a plurality of apertures aligned with a plurality of apertures of the first thick panel, a threaded insert positioned within each of the plurality of apertures of the first sheet portion and first thick panel.

6. The hockey training device of claim 1 wherein a front lengthwise edge of each of the slide blocks has a downwardly angled face.

7. The hockey training device of claim 1 wherein a front lengthwise edge of each of the slide blocks is at a right angle from a bottom surface of the slide block.

8. The hockey training device of claim 1 wherein the slide block has a first width at a first end that is less than a second width at a second end.

9. The hockey training device of claim 1 wherein the first elastic band is removably connected about the first pair of posts, and wherein the second elastic band is removably connected about the second pair of posts.

10. The hockey training device of claim 1 wherein the first side block is removably connected to the first pair of posts, and wherein the second slide block is removably connected to the second pair of posts.

11. The hockey training device of claim 1 wherein a front lengthwise edge of each of the slide blocks is at a right angle from a bottom surface of the slide block.

12. The hockey training device of claim 1 wherein the slide block has a first width at a first end that is less than a second width at a second end.

13. A hockey training device for training a plurality of hockey skills having a first mode for training a puck handling, and a second mode for training a skating motion, the device further comprising:

a sheet;

a first pair of posts extending from the sheet at a first end, each of the first pair of posts having a flange extending radially outwardly at a top of the post;

a second pair of posts extending from the sheet at a second end, each of the second pair of posts having a flange extending radially outwardly at a top of the post;

a first elastic band removably connectable to the first pair of posts, and a second elastic band removably connectable to the second pair of posts;

a first slide block removably connectable to the first pair of posts, and a second slide block removably connectable to the second pair of posts;

wherein each of the slide blocks comprises a block base, and two key hole slots defined in the base, each key hole slot having a circular region sized to allow passage of the flange of each post, and having a narrow region sized to allow passage of the post, but to prevent passage of the flange of each post;

wherein in the first mode, the first elastic band is connected to the first pair of posts, and the second elastic band is connected to the second pair of posts; and wherein in the second mode, the first slide block is connected to the first pair of posts, and the second slide block is connected to the second pair of posts.

14. The hockey training device of claim 10 wherein the key slots of each slide block are aligned in a lengthwise direction of the block.

15. The hockey training device of claim 10 wherein the key slots of each slide block are linearly offset in a lengthwise direction of the block.

16. The hockey training device of claim 10 wherein the sheet further comprises a hinge, the hinge connecting a first and second portion of the sheet, wherein the hinge is formed having a first thick panel attached to a bottom surface of the first sheet portion, a second thick panel attached to a bottom surface of the second sheet portion, and a thin portion connecting the first thick panel and second thick panel, the thin portion having a thickness less than a thickness of the first thick panel and a thickness of the second thick panel, wherein the first thick panel and second thick panel are movable about the thin portion.

17. The hockey training device of claim 15 wherein the first sheet portion further defines a plurality of apertures aligned with a plurality of apertures of the first thick panel, a threaded insert positioned within each of the plurality of apertures of the first sheet portion and first thick panel.

18. The hockey training device of claim 10 wherein a front lengthwise edge of each of the slide blocks has a downwardly angled face.

* * * * *